United States Patent [19]

Ogawa et al.

[11] Patent Number: 4,481,284

[45] Date of Patent: Nov. 6, 1984

[54] SILVER HALIDE PHOTOGRAPHIC LIGHT-SENSITIVE MATERIAL

[75] Inventors: Masashi Ogawa; Kunio Ishigaki; Nobuyuki Iwasaki; Taku Nakamura, all of Kanagawa, Japan

[73] Assignee: Fuji Photo Film Co., Ltd., Kanagawa, Japan

[21] Appl. No.: 420,687

[22] Filed: Sep. 21, 1982

[30] Foreign Application Priority Data

Sep. 21, 1981 [JP] Japan ..... 56/149081

[51] Int. Cl.[3] ..... G03C 5/16; G03C 1/76; G03C 1/30

[52] U.S. Cl. ..... 430/355; 430/351; 430/523; 430/539; 430/621; 430/627; 430/961

[58] Field of Search ..... 430/351, 355, 961, 627, 430/621–626, 523, 539

[56] References Cited

U.S. PATENT DOCUMENTS 4,357,418 11/1982 Cellone ..... 430/961

*Primary Examiner*—Mary F. Downey

*Attorney, Agent, or Firm*—Sughrue, Mion, Zinn, Macpeak and Seas

[57] ABSTRACT

A silver halide photographic light-sensitive material is disclosed, comprising a support having thereon at least one light-sensitive silver halide emulsion layer and a light-insensitive uppermost layer. The light-insensitive uppermost layer has a melting time longer than that of the light-sensitive silver halide emulsion layer and a thickness of the light-insensitive uppermost layer is from 0.3 μm to 0.8 μm. The silver halide photographic light-sensitive material causes a remarkably lower degree of reticulation, can reduce the amount of scum formed in the processing solution, and has an improved covering power.

37 Claims, No Drawings

SILVER HALIDE PHOTOGRAPHIC LIGHT-SENSITIVE MATERIAL

FIELD OF THE INVENTION

The present invention relates to a silver halide photographic light-sensitive material and, particularly, to a silver halide photographic light-sensitive material which causes a remarkably lower degree of reticulation, can reduce the amount of scum formed in the processing solution, and has an improved covering power.

BACKGROUND OF THE INVENTION

Generally, in order to have a relatively short development period when processing a light-sensitive material, the developing temperature is gradually increased to about 27° C. or more. Shorter developing times can be obtained by using an automatic developing apparatus capable of carrying out rapid development processing with good reproduction as described in U.S. Pat. Nos. 3,025,779 and 3,672,288, and *Rodal Technol.*, 44, No. 4, 257–261 (1973). The automatic developing apparatus generally includes a developing bath, a stopping bath, a fixing bath, a water wash bath and a drying zone. The conveying rate of films and processing temperature can be controlled within the apparatus.

Farnell et al. (*J. Phot. Sci.*, Vol. 18, page 94 (1970)) discloses that the covering power of a photographic light-sensitive material using a silver halide emulsion can be improved by varying the degree of hardening of the gelatin binder in order to vary the degree of swelling in the developing solution. It has been noted that the covering power increases with a decrease in the degree of hardening of the silver halide light-sensitive layer by reducing the amount of a hardening agent used. However, if the degree of hardening is extremely low, the strength of the emulsion layer deteriorates remarkably. Accordingly, when processed with the above described automatic developing apparatus, the silver halide emulsion layer is easily separated from the support and/or the emulsion layer is easily scratched by handling during the processing. Further, as another problem, the binder which may come out of the light-sensitive material, alone or by bonding to other components in the processing solution and/or the light-sensitive material, sometimes forms insoluble sediments in the processing solution in the automatic developing apparatus. Such insoluble sediments in the processing solution are generally referred to as "scum" in this field. When scum is formed in the processing solution, it adheres to the light-sensitive material passing through the automatic developing apparatus resulting in a considerable amount of stain. The scum adhering to the light-sensitive material causes remarkable deterioration of the quantity of images on the light-sensitive material, by which the commercial value is lost entirely.

Further, if high temperature rapid treatment is carried out, the photographic light-sensitive emulsion layer and other layers swell and soften excessively. When this happens it causes the physical strength to deteriorate and frequently causes the formation of network patterns called reticulation on the surface.

Accordingly, the degree of hardening of the silver halide emulsion layer must be increased to some degree in order to aid in avoiding the above described problems. However, as the degree of hardening is increased the covering power decreases. Although there are many known methods of hardening the silver halide emulsion layer, none of them overcome the above described contrary relationship.

As a result of extensive investigations relating to improving such problems, it is found that the drawbacks caused by scum can be substantially eliminated where the hardness of the light-insensitive uppermost layer (hereinafter, referred to as "uppermost layer") is increased utilizing a hardening technique capable of controlling the hardness of the uppermost layer and that of the silver halide emulsion layer, separately (i.e., selective hardening of the layers).

When dealing with a multilayer coating material, if the uppermost layer is hardened so as to have a hardness higher than that of the lower layer, network patterns called "reticulation" occur, and resulting in deterioration of the covering power, when high temperature treatment is utilized (edited by R. J. Cox, Jojo et al., *Photographic Gelatin*, pages 49–61 (1972), Academic Press).

In order to prevent the occurrence of reticulation, carboxylated methyl casein or sodium ethyl cellulose sulfate may be added to the uppermost layer as described in U.S. Defensive Publication No. 887,012. Alternatively, it is possible to add a carboxyl group containing polymer as described in Japanese Patent Application (OPI) No. 36021/77 (the term "OPI" as used herein refers to a "published unexamined Japanese patent application") or an acid-treated gelatin as described in U.S. Pat. No. 4,266,010. However, these methods are not always suitable, because the polymer dissolves in the processing solution during processing which tends to form scums. Furthermore, these processes have many production problems.

SUMMARY OF THE INVENTION

Accordingly, an object of the present invention is to provide a silver halide photographic light-sensitive material which does not cause reticulation when high temperature treatment is utilized and which has a good scum inhibition property as well as a high covering power.

Other objects of the present invention will be apparent from the following detailed description and examples.

The objects of the present invention have been attained with a silver halide photographic light-sensitive material comprising a support having thereon at least one light-sensitive silver halide emulsion layer and a light-insensitive uppermost layer, wherein the light-insensitive uppermost layer has a melting time longer than that of the light-sensitive silver halide emulsion layer and the thickness of the light-insensitive uppermost layer is from 0.3 μm to 0.8 μm.

DETAILED DESCRIPTION OF THE INVENTION

The present invention is described in greater detail below. As is known in the art, the degree of hardening can be controlled from layer to layer by the use of diffusion-resistant hardening agents. As such diffusion-resistant hardening agents, various polymeric hardening agents which have molecular weight of more than about 10,000 and at least one functional group reactive to gelatin to form cross-linking can be used in the silver halide photographic light-sensitive materials of the present invention. These hardening agents include those as described in, for example, U.S. Pat. Nos. 3,057,723, 3,396,029, 4,161,407, British Pat. No. 2,064,800 and U.S. Application Ser. No. 251,827. One preferred example of the polymeric hardening agent is that described in U.S. Application Ser. No. 251,827, which has a repeating unit represented by the following formula (I):

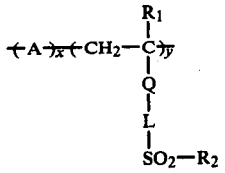

(I)

wherein A is a monomer unit prepared by copolymerizing copolymerizable ethylenically unsaturated monomers; $R_1$ is hydrogen or a lower alkyl group having 1 to 6 carbon atoms; Q is

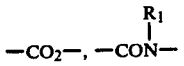

(wherein $R_1$ is the same as defined above) or an arylene group having 6 to 10 carbon atoms; L is a divalent group having 3 to 15 carbon atoms and containing at least one linking group selected from the members consisting of

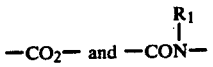

(wherein $R_1$ is the same as defined above) or a divalent group having 1 to 12 carbon atoms and containing at least one linking group selected from the members consisting of

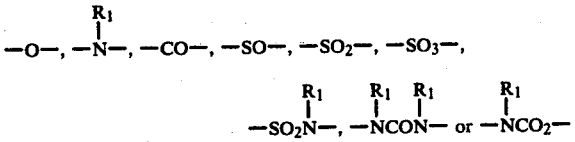

(wherein $R_1$ is the same as defined above); $R_2$ is $-CH=CH_2$ or $-CH_2CH_2X$ (wherein X is a group capable of being substituted with a nucleophilic group or a group capable of being released in the form of HX upon a base; and x and y each represents molar percent, x being between 0 and 99 and y being between 1 and 100.

Examples of ethylenically unsaturated monomers represented by "A" of formula (I) include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (e.g., vinyl acetate and allyl acetate), ethylenically unsaturated mono- or dicarboxylic acids and salts thereof (e.g., acrylic acid, methacrylic acid, itaconic acid, maleic acid, sodium acrylate, potassium acrylate and sodium methacrylate), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate and monobenzyl maleate), and amides of ethylenically unsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine). "A" further includes monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate).

Examples of $R_1$ of formula (I) includes a methyl group, an ethyl group, a butyl group and an n-hexyl group.

Examples of Q of formula (I) include the following groups:

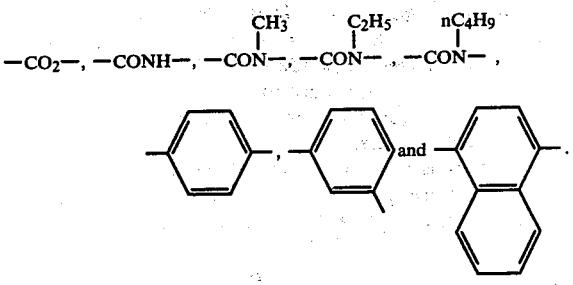

Examples of L of formula (I) include the following groups:

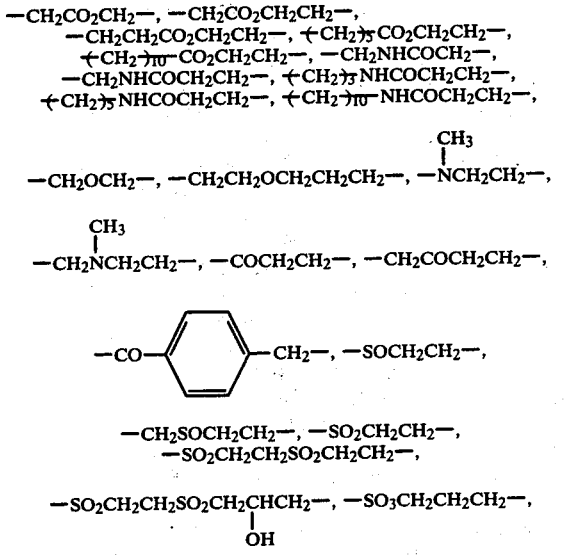

-continued $-SO_3CH_2CO_2CH_2CH_2-$, $-SO_3CH_2CH_2CO_2CH_2CH_2-$, $-SO_2NHCH_2CO_2CH_2CH_2-$, $-SO_2NHCH_2CH_2CO_2CH_2CH_2-$, $-NHCONHCH_2CH_2-$, $-CH_2NHCONHCH_2CH_2-$, $-NHCO_2CH_2CH_2-$, $-CH_2NHCO_2CH_2CH_2-$.

Examples of $R_2$ of formula (I) include the following groups:

$-CH{=}CH_2$, $-CH_2CH_2Cl$, $-CH_2CH_2Br$, $-CH_2CH_2O_3SCH_3$,

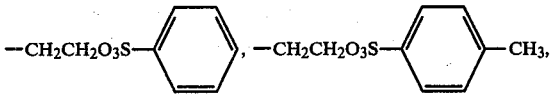

$-CH_2CH_2OH$, $-CH_2CH_2O_2CCH_3$, $-CH_2CH_2O_2CCF_3$ and $-CH_2CH_2O_2CCHCl_2$.

Another preferred example of the polymeric hardening agent is that described in U.S. Pat. No. 4,161,407, which has a repeating unit represented by the following formula (II):

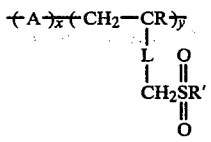

(II)

wherein A is a polymerized $\alpha,\beta$-ethylenically unsaturated addition polymerizable monomer or a mixture of such polymerizable monomers; x and y are the molar percentages of the resulting units in the polymer and are whole integers, x being from 10 to about 95 percent and y being 5 to 90 percent; R is hydrogen or an alkyl group having 1 to 6 carbon atoms; R' is $-CH{=}CHR_2$ or $-CH_2CH_2X$ where X is a leaving group which is displaced by a nucleophile or eliminated in the form of HX by treatment with base; $R_2$ is alkyl, aryl or hydrogen; —L— is a linking group selected from the group consisting of alkylene, preferably containing about 1 to 6 carbon atoms, such as methylene, ethylene, isobutylene and the like; arylene of about 6 to 12 nuclear carbon atoms, such as phenylene, tolylene, naphthalene and the like; —COZ— or $-COZR_3-$; $R_3$ is alkylene, preferably of 1 to 6 carbon atoms, or arylene, preferably of 6 to 12 carbon atoms; and Z is O or NH.

Examples of A of formula (II) include the same examples of A of formula (I), examples of R of formula (II) include the same examples of $R_1$ of formula (I) and examples of R' of formula (II) include the same examples of $R_2$ of formula (I), all of which are described above.

Still another preferred example of the polymeric hardening agent is that described in British Pat. No. 1,534,455, which has a repeating unit represented by the following formula (III):

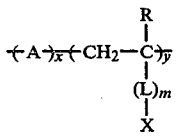

(III)

wherein A is a monomer unit copolymerized with a copolymerizable ethylenically unsaturated monomer; R is hydrogen or an alkyl group having 1 to 6 carbon atoms; L is a divalent linking group having 1 to 20 carbon atoms; X is an active ester group; x and y each represents molar percent, with x being between 0 and 95 and y being between 5 and 100 and m is 0 or 1.

Examples of A of formula (III) include the same examples of A of formula (I) and examples of R of formula (III) include the same examples of $R_1$ of formula (I), both of which are described above.

Examples of L of formula (III) include the following: $-CONHCH_2-$, $-CONHCH_2CH_2-$, $-CONHCH_2CH_2CH_2-$, $-CONHCH_2CH_2CH_2CH_2CH_2-$, $-CO_2CH_2CH_2OCOCH_2CH_2-$, $-CONHCH_2CONHCH_2-$, $-CONHCH_2CONHCH_2CONHCH_2-$, $-CO_2CH_2-$, $-CONHCH_2NHCOCH_2CH_2SCH_2CH_2-$, $-CONHCH_2OCOCH_2CH_2-$.

Examples of X of formula (III) include the following:

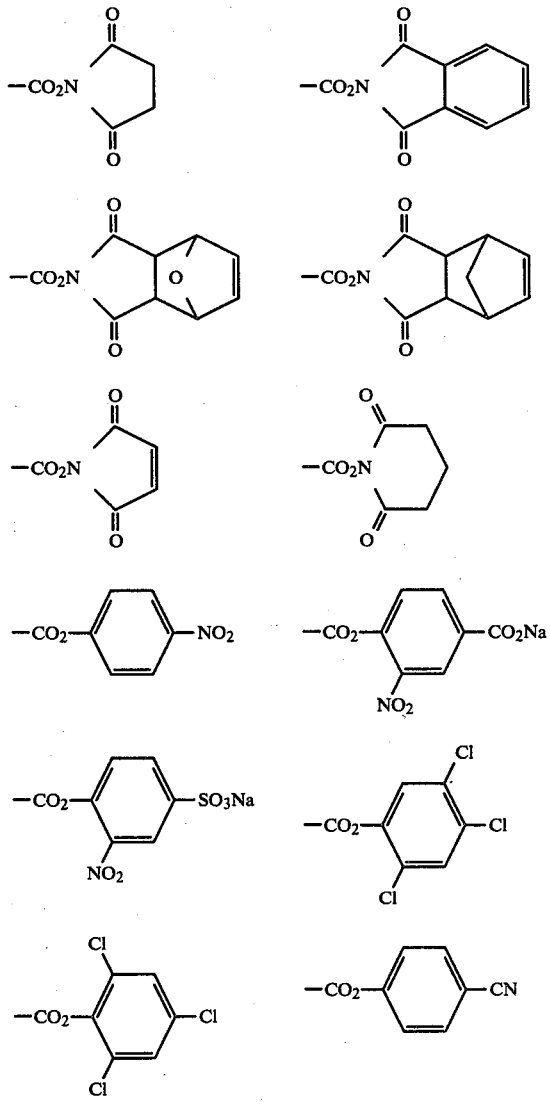

$-CO_2CH_2CN$ $-CO_2CH_2CO_2C_2H_5$ $-CO_2CH_2CONH_2$ $-CO_2CH_2COCH_3$

-continued

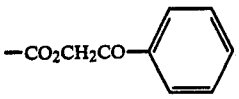

$-CO_2CH_2CO-$ $-CO_2N{=}CHCH_3$ $-CO_2C(CH_3){=}CHCOCH_3$ $-CO_2CH_2CH_2Br$ $-CO_2CH_2CO_2CH{=}CH_2$ $-CO_2N{=}C(CH_3)_2$

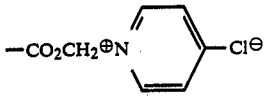

$-CO_2CH_2\overset{\oplus}{N}-Cl^{\ominus}$ $-CO_2CH_2CH_2CN$

-continued

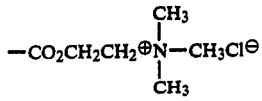

$-CO_2CH_2CH_2\overset{\oplus}{N}(CH_3)_2-CH_3Cl^{\ominus}$

Among the above preferred examples of the polymeric hardening agents, the polymeric hardening agent having repeating unit of formula (I) is particularly preferred.

Typical examples of the polymeric hardening agent are shown below as P-1 to P-22. Among them, P-1, 2, 5, 6 and 19 are more preferred, and P-1, 2 and 5 are particularly preferred.

| | | | |
|---|---|---|---|
| P-1 | $\leftarrow CH_2CH\rightarrow_x$ $CONHC(CH_3)_2CH_2SO_3Na$ | $\leftarrow CH_2CH\rightarrow_y$ $COOCH_2CH_2OCOCH_2SO_2CH{=}CH_2$ | x/y = 3/1 |
| P-2 | $\leftarrow CH_2CH\rightarrow_x$ $CONHC(CH_3)_2CH_2SO_3Na$ | $\leftarrow CH_2CH\rightarrow_y$ $CONHCH_2NHCOCH_2CH_2SO_2CH{=}CH_2$ | x/y = 3/1 |
| P-3 | $\leftarrow CH_2CH\rightarrow_x$ $CONHC(CH_3)_2CH_2SO_3Na$ | $\leftarrow CH_2CH\rightarrow_y$ $CONHCH_2CH_2CH_2NHCOCH_2CH_2SO_2CH{=}CH_2$ | x/y = 3/1 |
| P-4 | $\leftarrow CH_2CH\rightarrow_x$ $CONHC(CH_3)_2CH_2SO_3Na$ | $\leftarrow CH_2CH\rightarrow_y$ 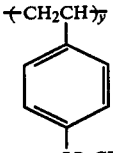 $SO_2CH_2CH_2SO_2CH{=}CH_2$ | x/y = 3/1 |
| P-5 | $\leftarrow CH_2CH\rightarrow_x$ $CONHC(CH_3)_2CH_2SO_3Na$ | $\leftarrow CH_2CH\rightarrow_y$ 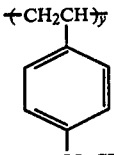 $SO_2CH_2CH_2SO_2CH_2CH(OH)CH_2SO_2CH{=}CH_2$ | x/y = 3/1 |
| P-6 | $\leftarrow CH_2CH\rightarrow_x$ $CONHC(CH_3)_2CH_2SO_3Na$ | $\leftarrow CH_2CH\rightarrow_y$ 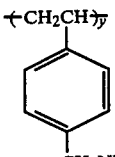 $CH_2NHCOCH_2CH_2SO_2CH{=}CH_2$ | x/y = 3/1 |
| P-7 | $\leftarrow CH_2CH\rightarrow_x$ $CONHC(CH_3)_2CH_2SO_3Na$ | $\leftarrow CH_2CH\rightarrow_y$ $NHCONHCH_2SO_2CH{=}CH_2$ | x/y = 3/1 |
| P-8 | $\leftarrow CH_2CH\rightarrow_x$ $CONHC(CH_3)_2CH_2SO_3Na$ | $\leftarrow CH_2CH\rightarrow_y$ $CONHCOCH_2CH_2SO_2CH{=}CH_2$ | x/y = 3/1 |
| P-9 | $\leftarrow CH_2CH\rightarrow_x$ $CONHC(CH_3)_2CH_2SO_3Na$ | $\leftarrow CH_2CH\rightarrow_y$ $COOCH_2CH_2OCOCH_2SO_2CH_2CH_2Cl$ | x/y = 3/1 |
| P-10 | $\leftarrow CH_2CH\rightarrow_x$ $CONHC(CH_3)_2CH_2SO_3Na$ | $\leftarrow CH_2CH\rightarrow_y$ $CONHCH_2NHCOCH_2CH_2SO_2CH_2CH_2Cl$ | x/y = 3/1 |
| P-11 | $\leftarrow CH_2CH\rightarrow_x$ $CONHC(CH_3)_2CH_2SO_3Na$ | $\leftarrow CH_2CH\rightarrow_y$ $CONHCH_2NHCOCH_2CH_2SO_2CH_2CH_2Br$ | x/y = 3/1 |

-continued

| | | | |
|---|---|---|---|
| P-12 | $\leftarrow CH_2CH \rightarrow_x$ <br> $CONHC(CH_3)_2CH_2SO_3Na$ | $\leftarrow CH_2CH \rightarrow_y$ <br> $CH_2NHCOCH_2CH_2SO_2CH_2CH_2Cl$ | x/y = 3/1 |
| P-13 | $\leftarrow CH_2CH \rightarrow_x$ <br> $CONHC(CH_3)_2CH_2SO_3Na$ | $\leftarrow CH_2CH \rightarrow_y$ <br> $SO_2CH_2CH_2SO_2CH_2CH(OH)-CH_2SO_2CH_2CH_2Cl$ | x/y = 3/1 |
| P-14 | $\leftarrow CH_2CH \rightarrow_x$ <br> $CONHC(CH_3)_2CH_2SO_3Na$ | $\leftarrow CH_2CH \rightarrow_y$ <br> $CONHCOCH_2CH_2SO_2CH_2CH_2Cl$ | x/y = 3/1 |
| P-15 | $\leftarrow CH_2CH \rightarrow_x$ <br> $COOM$ | $\leftarrow CH_2CH \rightarrow_y$ <br> $CONHCH_2COCH_2CH_2SO_2CH_2CH_2Cl$ | x/y = 3/1 |
| P-16 | $\leftarrow CH_2CH \rightarrow_x$ <br> $COOM$ | $\leftarrow CH_2CH \rightarrow_y$ <br> $CONHCH_2NHCOCH_2CH_2SO_2CH=CH_2$ | x/y = 3/1 |
| P-17 | $\leftarrow CH_2CH \rightarrow_x$ <br> $COOM$ | $\leftarrow CH_2CH \rightarrow_y$ <br> $CH_2NHCOCH_2CH_2SO_2CH=CH_2$ | x/y = 3/1 |
| P-18 | $\leftarrow CH_2CH \rightarrow_x$ <br> $COOM$ | $\leftarrow CH_2CH \rightarrow_y$ <br> $CH_2NHCOCH_2CH_2SO_2CH_2CH_2Cl$ | x/y = 3/1 |
| P-19 | $\leftarrow CH_2CH \rightarrow_x$ <br> $COOM$ | $\leftarrow CH_2CH \rightarrow_y$ <br> $SO_2CH_2CH_2SO_2CH_2CH(OH)CH_2SO_2CH=CH_2$ | x/y = 3/1 |
| P-20 | $\leftarrow CH_2CH \rightarrow_x$ <br> $COOM$ | $\leftarrow CH_2CH \rightarrow_y$ <br> $SO_2CH_2CH_2SO_2CH_2CH(OH)CH_2SO_2CH_2CH_2Cl$ | x/y = 3/1 |
| P-21 | $\leftarrow CH_2CH \rightarrow_x$ <br> $COOM$ | $\leftarrow CH_2CH \rightarrow_y$ <br> $COOCH_2CH_2OCOCH_2SO_2CH=CH_2$ | x/y = 3/1 |
| P-22 | $\leftarrow CH_2CH \rightarrow_x$ <br> $COOM$ | $\leftarrow CH_2CH \rightarrow_y$ <br> $COOCH_2CH_2OCOCH_2SO_2CH_2-CH_2Cl$ | x/y = 3/1 |

In the above formulae, M represents hydrogen, a sodium atom or a potassium atom, preferably the sodium atom or the potassium atom and particularly preferably the sodium atom, and x and y represent the molar percent of the corresponding units charged. The molar percent is not limited to those specified in the above formulae, x may be from 0 to 90, and y may be from 1 to 100.

A preferred range of the molecular weight of the polymeric hardening agents is 10,000 to 1,000,000 and a more preferred range thereof is 30,000 to 500,000.

Methods of synthesizing typical ethylenically unsaturated monomers containing a vinyl sulfone group or a functional group that is a precursor thereof which are used in the preparation of the polymeric hardening agents for use in the present invention will hereinafter be specifically described.

SYNTHESIS EXAMPLE 1

Synthesis of 2-[3-(Chloroethylsulfonyl)propionyloxy]ethyl Acrylate

A mixture of 600 ml of tetrahydrofuran, 45.8 g of hydroxyethyl acrylate, and 72 g of 3-(2-chloroethylsulfonyl)propionic acid chloride was placed in a reactor, and while maintaining the temperature at 5° C. or lower by cooling by ice water, a solution containing 31.2 g of pyridine dissolved in 100 ml of tetrahydrofuran was added dropwise thereto over a period of 1.75 hours. The resulting mixture was further stirred for 2 hours at room temperature. At the end of the time, the reaction mixture was poured into 2.5 liters of ice water, and extraction was performed four times with 300 ml of chloroform. The organic layer thus extracted was dried over sodium sulfate and concentrated to provide 87 g of 2-[3-(chloroethylsulfonyl)propionyloxy]ethyl acrylate which shows a pale yellow color and a state of wax. Yield was 88%.

SYNTHESIS EXAMPLE 2

Synthesis of [3-(Chloroethylsulfonyl)propionyl]aminomethylstyrene

A mixture of 100 ml of tetrahydrofuran, 20.1 g of vinylbenzylamine, 16.7 g of triethylamine, and 0.1 g of hydroquinone was placed in a reactor, and while cooling with ice water, a solution containing 36.1 g of β-chloroethylsulfonylpropionic acid chloride dissolved in 200 ml of tetrahydrofuran was added dropwise thereto over a period of 30 minutes. The resulting mixture was allowed to stand overnight at room temperature. The reaction mixture was then poured into a solution prepared by diluting 16.5 g of concentrated hydrochloric acid with 1.5 liters of ice water, and the thus formed precipitate was collected by filtration. The precipitate was recrystallized from a solvent mixture of 200 ml of ethanol and 200 ml of water to provide 26.8 g of N-vinylbenzyl-β-chloroethylsulfonyl propionic acid amide having a melting point of 109° to 112° C. Yield was 57%.

Elemental Analysis (found): H, 5.74; C, 53.47; N, 4.83; Cl, 10.99; S, 10.49.

SYNTHESIS EXAMPLE 3

Synthesis of 1-{[2-(4-Vinylbenzenesulfonyl)ethyl]sulfonyl}-3-chloroethylsulfonyl-2-propanol A mixture of 157 g of 1,3-bischloroethylsulfonyl-2-propanol (prepared by the method described in U.S. Pat. No. 4,173,481, 1 liter of methanol, and 1 liter of distilled water was placed in a reactor, and while maintaining the temperature at 46° C. by heating, a solution prepared by dissolving 52 g of potassium vinylbenzenesulfinate in 100 ml of methanol and 100 ml of distilled water was added dropwise thereto over a period of 1 hour. The resulting mixture was further stirred for 5.5 hours while maintaining at 46° C. The precipitate thus formed was collected by filtration to obtain 55 g of 2-(1-vinylbenzenesulfonyl)ethylsulfonyl-3-chloroethylsulfonyl-2-propanol having a melting point of more than 200° C. Yield was 49%.

Elemental Analysis (found): H, 4.67; C, 39.89; S, 21.43.

SYNTHESIS EXAMPLE 4

Synthesis of N-{[3-(Chloroethylsulfonyl)propionyl]aminomethyl}-acrylamide

In a 2 liter reactor was introduced 1,400 ml of distilled water, 224 g of sodium sulfite, and 220 g of sodium hydrogencarbonate, which were then stirred to form a uniform solution. Then, while maintaining the temperature at about 5° C. by cooling with ice water, 260 g of chloroethanesulfonyl chloride was added dropwise thereto over a period of 1.5 hours. After the dropwise addition was completed, 160 g of 49% sulfuric acid was added dropwise thereto over a period of about 15 minutes, and the resulting mixture was stirred for 1 hour at 5° C. Crystals precipitated were collected by filtration and washed with 400 ml of distilled water. The filtrate and the washing liquid were combined together and placed in a 3 liter reactor. Into the reactor was introduced dropwise a solution containing 246 g of methylenebisacrylamide dissolved in 480 ml of distilled water and 1,480 ml of ethanol while maintaining the temperature at about 5° C. by cooling with ice over a period of 30 minutes. The reactor was then placed in a refrigerator and was allowed to stand for 5 days to complete the reaction. Crystals precipitated were collected by filtration and, thereafter, they were washed with 800 ml of cooled distilled water and recrystallized from 2,000 ml of a 50% aqueous solution of ethanol to obtain 21 g of the desired monomer having a melting point of more than 192° C. Yield was 49%.

In addition, specific examples of methods of synthesizing polymeric hardening agents which can be used in the present invention will hereinafter be described.

SYNTHESIS EXAMPLE 5

Synthesis of 2-[3-(Vinylsulfonyl)propionyloxy]ethyl Acrylate/Sodium Acrylamido-2-methylpropanesulfonate Copolymer (P-1)

A mixture of 60 ml of N,N-dimethylformamide, 14.5 g of 2-[3-(chloroethylsulfonyl)propionyloxy]ethyl acrylate, and 23.5 g of acrylamido-2-methylpropanesulfonic acid was placed in a reactor. After purging with nitrogen gas, the mixture was heated to 60° C., and 0.40 g of 2,2'-azobis(2,4-dimethylvaleronitrile) was added thereto. The resulting mixture was stirred for 2 hours while heating at that temperature. Subsequently, 0.2 g of 2,2'-azobis(2,4-dimethylvaleronitrile) was added, and the mixture was stirred for 2 hours while heating. At the end of the time, the mixture was cooled down to 5° C., and 12 g of sodium carbonate and 4.9 g of triethylamine were added. The resulting mixture was stirred for 1 hour and additionally for 1 hour at room temperature. The reaction mixture was placed in a tube of cellulose and was subjected to dialysis for 2 days. The product was freeze-dried to obtain 35 g of a white polymer. Yield was 95%. The vinylsulfone content of the polymer thus formed was $0.51\times10^{-3}$ equivalent/g.

SYNTHESIS EXAMPLE 6

Synthesis of
[3-(Vinylsulfonyl)propionyl]aminomethylstyrene/-Sodium Acrylamido-2-methylpropanesulfonate Copolymer (P-6)

A mixture of 15.8 g of [3-(chloroethylsulfonyl)propionyl]aminomethylstyrene, 23.6 g of sodium acrylamido-2-methylpropanesulfonate, and 75 ml of N,N-dimethylformamide was placed in a reactor. After purging with nitrogen gas, the mixture was heated to 80° C., and 0.75 g of 2,2'-azobis(2,4-dimethylvaleronitrile) was added thereto. The resulting mixture was stirred for 3 hours while heating. Then, 25 ml of N,N-dimethylformamide was added, and subsequently 6.1 g of triethylamine was added dropwise at room temperature. The resulting mixture was stirred for 1 hour at room temperature. At the end of the time, the reaction mixture was filtered. The filtrate thus obtained was poured into 800 ml of acetone, and the thus-formed precipitate was collected by filtration and dried to obtain 36.2 g of pale yellow polymer. Yield was 94%. The vinylsulfone content of the polymer was $0.80\times10^{-3}$ equivalent/g.

SYNTHESIS EXAMPLE 7

Synthesis of
1-{[2-(4-Vinylbenzenesulfonyl)ethyl]sulfonyl}-3-vinylsulfonyl-2-propanol/Sodium Acrylate Copolymer (P-19)

A mixture of 300 ml of N,N-dimethylformamide, 40.1 g of 2-(1-vinylbenzenesulfonyl)ethylsulfonyl-3-chloroethylsulfonyl-2-propanol, and 13.0 g of acrylic acid was placed in a reactor. After purging with nitrogen gas, the mixture was heated to 70° C., and 0.53 g of 2,2'-azobis(2,4-dimethylvaleronitrile) was added thereto. The resulting mixture was heated for 1.5 hours while stirring. Subsequently, 0.53 g of 2,2'-azobis(2,4-dimethylvaleronitrile) was added thereto, and the mixture was further heated for 1 hour while stirring. The reaction mixture was allowed to cool down to room temperature, and 54.8 g of a 28% methanol solution of sodium methylate was added dropwise thereto. Stirring was further continued for 1 hour. The reaction mixture was placed in a tube of cellulose and was subjected to dialysis for 2 days. The product was freeze-dried to obtain 30 g of pale yellow polymer. Yield was 56%. The vinylsulfone content of the polymer was $1.4\times10^{-3}$ equivalent/g.

SYNTHESIS EXAMPLE 8

Synthesis of
N-{[3-(Vinylsulfonyl)propionyl]aminomethyl}acrylamide/Sodium Acrylamido-2-methylpropanesulfonate Copolymer (P-2)

A mixture of 5.65 g of the monomer prepared in Synthesis Example 1, 9.16 g of sodium acrylamido-2-methylpropanesulfonate, and 80 ml of a 50% aqueous solution of ethanol was placed in a 200 ml reactor, and was heated to 80° C. while stirring. At this temperature, 0.1 g of 2,2'-azobis(2,4-dimethylvaleronitrile) (sold by Wako Pure Chemical Industries Ltd. under the trade name of V-65) was added and additionally, after 30 minutes, 0.1 g of the same compound as above was added. The mixture was heated for 1 hour while stirring. Thereafter, the reaction mixture was cooled down to about 10° C. with ice water, and a solution containing 2.5 g of triethylamine dissolved in 80 ml of ethanol was added thereto. Stirring was further continued for 1 hour. At the end of the time, the reaction mixture was poured into 1 liter of acetone while stirring, and the thus-formed precipitate was collected by filtration to obtain 12.4 g of Polymer (P-2). Yield was 85%. The intrinsic viscosity, [$\eta$], was 0.227, and the vinylsulfone content was $0.95\times10^{-3}$ equivalent/g.

In hardening the emulsion layer, polymeric hardening agents as described hereinbefore may be used either singly or in combination with a diffusible low-molecular hardening agent. Diffusible hardening agents which can be used include various organic and inorganic hardening agents which are used either singly or in combination with each other. Typical examples of such hardening agents include an aldehyde compound, e.g., mucochloric acid, formaldehyde, trimethylolmelamine, glyoxal, 2,3-dihydroxy-1,4-dioxane, 2,3-dihydroxy-5-methyl-1,4-dioxane, succinaldehyde, and glutaraldehyde; an active vinyl compound, e.g., divinyl sulfone, methylenebismaleimide, 1,3,5-triacryloylhexahydro-s-triazine, 1,3,5-trivinylsulfonylhexahydro-s-triazine, bis(vinylsulfonylmethyl)ether, 1,3-bis(vinylsulfonyl)propanol-2, 1,3-bis(vinylsulfonylacetamido)propane, 1,2-bis(vinylsulfonylacetamido)ethane, di(vinylsulfonylacetamido)methane, 1,2-bis(vinylsulfonyl)ethane, and 1,1'-bis(vinylsulfonyl)methane; an active halogeno compound, e.g., 2,4-dichloro-6-hydroxy-s-triazine; and an ethyleneimine compound, e.g., 2,4,6-triethyleneimino-s-triazine. Of them, the active vinyl compound or the active halogeno compound is preferred. These compounds are well known in the art as hardening agents for gelatin.

The polymeric hardening agent is dissolved in water or an organic solvent and, thereafter, is added directly to a layer which is to be controlled in the degree of hardening. In the case of a diffusible hardening agent, it may be added directly to the layer which is to be controlled in the degree of hardening, or alternatively it may be added to another layer and then diffused in the whole layer. The amount of the polymeric hardening agent added is determined by the amount of the reactive group in the polymeric hardening agent. The practical method for determining the amount of the polymeric hardening added preferably includes determining optimum point of degree of hardening of coating layers by experimentation wherein the degree of hardening is measured depending upon the amount of the polymeric hardening agent.

The polymeric hardening agent may be used either singly or in combination with a diffusible hardening agent.

In accordance with another technique to control the degrees of hardening of coating layers, a low molecular hardening agent is employed. By controlling the method of addition and drying conditions, or using other additives for controlling the diffusing properties, diffusion properties are controlled. For example, a diffusible vinylsulfone hardening agent is incorporated into only a coating solution for a surface protective layer and, after a plurality of layers are coated at the same time, the layers are rapidly dried whereby the degree of hardening can be changed from layer to layer.

Measures well known in the art for evaluation of the degree of hardening of a hardened layer include the degree of swelling as determined by swelling the hardened layer in a certain solution, and the scratching strength which is indicated by determining the load at which the hardened layer is scratched by a needle-like stylus under the load. However, in order to evaluate the prevention of scum (which is one of the purposes of the present invention), it is most effective to employ a melting time (MT). The melting time is the time required for a hardened layer to melt when it is soaked in a solution maintained at a certain temperature. It is most preferred to measure the melting time in a 0.2N NaOH solution maintained at 60° C. although the present invention is not limited thereto.

When the present invention is applied to an X-ray photographic light-sensitive material, it is preferred that the melting times of the silver halide emulsion layer and the surface protective layer determined in the above described conditions are form 30 sec. to 200 sec. and 200 sec. to 700 sec., respectively.

The relation between the melting time of the light-sensitive uppermost layer (MTi) and that of the light-sensitive silver halide emulsion layer (MTs) employed in the presint invention can be represented by MTi/MTs ratio. The ratio is usually in a range of more than 1.05 and less than 20, preferably more than 1.05 and less than 10, and most preferably more than 3 and less than 6.

The degree of hardening of the coating layers is about 10 times or more as large as that of the X-ray photographic light-sensitive material, when using lithographic light-sensitive material, and is several times or more as large as that of the X-ray photographic light-sensitive material.

The photographic light-sensitive material of the present invention is characterized in that the uppermost layer has a melting time longer than that of the silver halide emulsion layer and a thickness of from 0.2 μm to 0.8 μm. When the thickness of the uppermost layer is greater than 0.8 μm, reticulation tents to occur. On the contrary, when the thickness of the uppermost layer is less than 0.3 μm, the handling property of the photographic light-sensitive material, for example, an abrasion resistance on the surface of the layer in a drying condition is adversely affected while the occurrence of reticulation is prevented.

On the uppermost layer which has a thickness of from 0.3 μm to 0.8 μm and has a melting time longer than that of the light-sensitive silver halide emulsion layer, a gelatin overcoat layer may be, further, applied.

It is preferred that said overcoat layer has a melting time shorter than that of the light-sensitive silver halide emulsion layer and a thickness of the overcoat layer is as thin as possible.

A thickness of the silver halide emulsion layer is preferably from 1 μm to 15 μm, more preferably form 1.5 μm to 10 μm and particularly preferably from 2 μm to 5 μm.

In the silver halide photographic light-sensitive material of the present invention, a gelatin-containing light-insensitive layer may be provided under the silver halide emulsion layer, if desired.

The silver halide emulsion as used in the present invention is ordinarily prepared by mixing a water-soluble silver salt (e.g., silver nitrate) silution and a water-soluble halogenide (e.g., potassium bromide) solution in the presence of a water-soluble polymer (e.g., gelatin) solution.

Silver halides which can be used include a mixed silver halide, e.g., silver chlorobromide, silver iodobromide, and silver chloroiodobromide, as well as silver chloride, silver bromide, and silver iodide.

These silver halide grains can be prepared by generally known techniques. It is also useful to prepare them by methods such as the so-called single or double jet method, and control double jet method.

Photographic emulsions are well known as described in, for example, Mees, *The Theory of Photographic Process,* Macmillan Corp., and P. Glafkides, *Chimie Photographique,* Paul Montel (1957), and can be prepared by various known techniques such as an ammonia method, a neutral method, and an acidic method.

Silver halide emulsions are usually subjected to chemical sensitization although so-called primitive emulsions not subjected to chemical sensitization may be used. Chemical sensitization can be achieved by the methods as described in the above-described reference by P. Glafkides, the book by Zelikman, and H. Frieser Ed., *Die Grundlagen der Photographischen Prozesse mit Silberhalogeniden,* Akademische Verlagsgesellschaft (1968).

A sulfur sensitization method in which compounds containing sulfur capable of reacting with a silver ion, and active gelatin are used, a reduction sensitization method in which reducing compounds are used, a noble metal sensitization method in which gold and other noble metal compounds are used, and so forth can be used either singly or in combination with each other.

Sulfur sensitizers which can be used include thiosulfates, thioureas, thiazoles, and rhodanines. These compounds are described in U.S. Pat. Nos. 1,574,944, 2,410,687, 2,278,947, 2,728,668, 3,656,955, 4,030,928 and 4,067,740. Reduction sensitizers which can be used include stannous salts, amines, hydrazine derivatives, formamidinesulfinic acid, and silane compounds. These compounds are described in U.S. Pat. Nos. 2,487,850, 2,419,974, 2,518,698, 2,983,609, 2,983,610, 2,694,637, 3,930,867 and 4,054,458. For noble metal sensitization, in addition to gold complex salts, complex salts of Group VIII metals, e.g., platinum, iridium, and palladium, of the Periodic Table can be used. These compounds are described in U.S. Pat. Nos. 2,399,083 and 2,448,060, and British Pat. No. 618,061.

Hydrophilic colloids which can be used in the present invention as binders for the silver halide include high molecular weight gelatin, colloidal albumin, casein, cellulose derivatives, e.g., carboxymethyl cellulose, and hydroxyethyl cellulose, sugar derivatives, e.g., agar, sodium alginate, and starch derivatives, and synthetic hydrophilic colloids, e.g., polyvinyl alcohol, poly-N-vinylpyrrolidone, polyacrylic acid copolymers, and polyacrylamide, or their derivatives or partially hydrolyzed products. If necessary, mixtures comprising two or more mutually soluble colloids of the above-described compounds may be used. Of the above-described compounds, gelatin is most commonly used. Part or the whole of gelatin may be displaced by a synthetic polymeric substance. In addition, it may be displaced by a graft polymer prepared by bonding molecular chains of other polymeric substances. Furthermore, gelatin derivatives prepared by treating the usual high molecular weight gelatin with reagents containing a group capable of reacting with an amino group, an imino group, a hydroxy group, or a carboxy group contained in the gelatin may be used partially.

Various compounds may be incorporated into the photographic emulsions used herein for the purpose of preventing the formation of fog or stabilizing photographic performance during the production of light-sensitive materials, the storage thereof or the photographic processing thereof. Compounds which can be used for that purpose include azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially, 1-phenyl-5-mercaptotetrazole); mercaptopyrimidines; mercaptotriazines; thioketo compounds, e.g., oxazolinethion; azaindenes, e.g., triazaindenes, tetraazaindenes (especially, 4-hydroxy-substituted (1,3,3a,7)tetraazaindenes), and pentaazaindenes; and benzenethiosulfonic acid, benzenesulfinic acid, and benzenesulfonic acid amide, which are known as anti-foggants or stabilizers.

Photographic emulsion layers and other hydrophilic colloid layers in the light-sensitive materials of the present invention may contain various known surfactants as coating aids or for various purposes of prevention of charging, improvement of sliding properties, emulsification and dispersing, prevention of adhesion, and improvement of photographic characteristics (e.g., acceleration of development, high contrast, and sensitization).

Photographic emulsions as used herein may be subjected to spectral sensitization using methine dyes, etc. Dyes which can be used include cyanine dyes, merocyanine dyes, complex cyanine dyes, complex merocyanine dyes, holopolar cyanine dyes, hemicyanine dyes, styryl dyes, and hemioxonol dyes.

Photographic emulsion layers or their adjacent layers in the photographic light-sensitive materials of the present invention may contain, for the purpose of increasing sensitivity, increasing contrast, or for accelerating development, polyalkylene oxide or its ether, ester, amine or like derivatives, thioether compounds, thiomorpholines, quaternary ammonium salt compounds, urethane derivatives, urea derivatives, imidazole derivatives, 3-pyrazolidones, and the like.

There are no limitations on surfactants, chemical sensitizers, silver halide, stabilizers, antifoggants, antistatic agents, matting agents, spectral sensitizing dyes, dyes, color couplers, supports, and so forth, which are used in the silver halide emulsion layers and other hydrophilic colloid layers of the present invention. These additives are described in, for example, *Research Disclosure,* Vol. 176, pp. 22–31 (Dec., 1978) and Japanese Patent Application (OPI) No. 99928/78.

The method of exposure of the light-sensitive material of the present invention is not critical, and the exposure time may be either as long as from 1 second to several minutes or as short as from $10^{-6}$ to $10^{-3}$ second.

Preferred examples of automatic developing machines which can be used in the development of the light-sensitive material of the present invention include a roller conveyor type automatic developing machine, a belt conveyor type automatic developing machine, and a hanger type automatic developing machine. The development processing temperature is preferably from 20° to 60° C. and more preferably from 27° to 45° C., and the development time is preferably from 10 seconds to 10 minutes and more preferably from 20 seconds to 5 minutes. Development processing steps, the composition of processing liquids, and so forth may be chosen referring to the above-described Research Disclosure and British Pat. No. 1,599,951 and also to C. E. K. Mees and T. H. James, *The Theory of Photographic Processes,* 3rd Ed., Chapter 13, Macmillan Co. (1966) and L. F. A. Mason, *Photographic Processing Chemistry,* pp. 16–30, Oxford Press (1966).

In the following, the present invention is further illustrated with reference to examples, but the present invention is not limited to them.

EXAMPLE 1

On both sides of a polyethylene terephthalate film support having a thickness of about 175μ the both surfaces of which were subjected to undercoating, layers having the following compositions were provided in turn to prepare Samples 1 to 5.

Each layer of each sample contained a hardening agent as shown in Table 1 below.

Emulsion Layer
Binder: Gelatin 2.0 g/m$^2$
Coating amount of silver: 2.0 g/m$^2$
Composition of silver halide:
AgI 2% by mol+AgBr 98% by mol
Anti-foggant:
1-Phenyl-5-mercaptotetrazole 0.5 g/Ag 100 g
4-Hydroxy-(1,3,3a,7)tetraazaindene 0.8 g/Ag 100 g
Protective Layer
Binder: Gelatin
Coating aid:
N-oleoyl-N-methyltaurine sodium salt 7 mg/m$^2$
Matting agent:
Polymethyl methacrylate (average particle size 5μ) 25 mg/m$^2$ The degree of the hardening of each layer of these samples were measured by the following method. The coated sample was cut into 0.5 cm widths and 4 cm lengths and immersed in an alkali solution (0.2N aqueous solution of sodium hydroxide) kept at 60° C. The time at which dissolution of the emulsion layer and the uppermost layer began was measured to determine the melting time (second: M.T.).

The film strength was measured as follows. After the coated sample was immersed in the developing solution RD-III (produced by Fuji Photo Film Co., Ltd.) at 35° C. for 25 seconds, a needle equipped with a stainless steel ball having a diameter of 0.5 mm on the tip end thereof was pressed against the film face. The weight applied to the needle was continuously varied while moving the film at a rate of 5 mm/sec. The film strength was represented by the weight (g) at which the film was broken (occurrence of a scratch).

The sensitometric characteristic was measured after the sample was exposed to light for 1/20 second using a conventional tungsten sensitometer and processed by an automatic development apparatus as follows.

| Processing Step | Processing Temperature (°C.) | Processing Time (sec) |
|---|---|---|
| Development | 35 | 23 |
| Fixing | 33 | 23 |
| Water Washing | 33 | 16 |
| Draining | — | 11 |
| Drying | 50 | 18 |

The developing solution used was one commercially available for ultra-rapid treatment: RD-III for Fuji X-ray automatic development apparatus (produced by Fuji Photo Film Co., Ltd.).

The fixing solution used was a commercially available fixing solution for X-ray automatic development apparatus: Fuji F (produced by Fuji Photo Film Co., Ltd.).

weight separation with gelchromatography (Matrix: Sephatex G-50). The amount of gelatin contained in 100 cc of the developing solution is shown in milligrams. The results are shown in Table 2 below.

TABLE 1

| Sample No. | Protective Layer: Gelatin Hardening Agent | Protective Layer: Milliequivalent/Gelatin in Protective Layer 100 g | Amount of Gelatin ($g/m^2$) | Silver Halide Emulsion Layer: Gelatin Hardening Agent | Silver Halide Emulsion Layer: Milliequivalent/Gelatin in Layer 100 g |
|---|---|---|---|---|---|
| 1 Comparison | — | — | 1.4 (1.0μ) | H-1 | 0.6 |
| 2 Comparison | — | — | 1.4 (1.0μ) | H-1 | 1.35 |
| 3 Comparison | P-2 | 1.5 | 1.4 (1.0μ) | H-1 | 0.6 |
| 4 Present Invention | P-2 | 1.5 | 0.7 (0.5μ) | H-1 | 0.6 |
| 5 Present Invention | P-2 | 1.5 | 0.4 (0.3μ) | H-1 | 0.6 |

H-1: 1,2-Bis(vinylsulfonylacetamido)ethane

TABLE 2

| Sample No. | Melting Time (0.2 N, NaOH, 60° C.): Protective Layer (sec) | Melting Time (0.2 N, NaOH, 60° C.): Emulsion Layer (sec) | Film Strength (g) | Degree of Reticulation | Covering Power | Scum: Muddiness of Fixing Solution | Scum: Stain of Processed Film | Amount of Gelatin Dissolved (mg/100 cc of developing solution) |
|---|---|---|---|---|---|---|---|---|
| 1 Comparison | 105 | 105 | 66 | A | 0.85 | x | D | 210 |
| 2 Comparison | 290 | 290 | 83 | A | 0.49 | o | A | 105 |
| 3 Comparison | 380 | 109 | 63 | C | 0.54 | o | A | 99 |
| 4 Present Invention | 386 | 103 | 71 | A | 0.86 | o | A | 95 |
| 5 Present Invention | 382 | 99 | 69 | A | 0.87 | o | A | 90 |

The covering power is a value calculated by dividing a value obtained by subtracting the density of the base from the maximum density by the amount of silver ($g/m^2$), which means the density resulting from the same amount of silver. Namely, the same density can be obtained with a smaller amount of silver if the value of covering power is larger.

After carrying out the same development processing as described above, the degree of reticulation which occurred on each sample was examined. The degree of reticulation is indicated by the following three stages A, B and C.

A: Reticulation is not observed at all when magnified to 100 times by a microscope.

B: Reticulation is slightly observed when magnified to 100 times by a microscope.

C: Reticulation is remarkably observed when magnified to 100 times by a microscope.

The examination of scum was carried out as follows. 200 Sheets of coating samples 8.5 cm in width and 30 cm in length were allowed to pass through a portable automatic development apparatus equipped with a 2 l developing bath and a 2 l fixing bath in which RD-III and Fuji-F were used, and the degree of muddiness of each processing solution and the degree of stain of the processed film were examined.

The degree of stain of the processed film (degree of scum occurrence) was shown by the following four stages A, B, C and D.

A: Stain is not caused at all up to 200 sheets of processed film.

B: Stain is slightly caused in the range of 150 to 200 sheets of processed film.

C: Occurrence of scum is slightly observed when 100 sheets or more were processed.

D: Occurrence of scum is considerably observed when 25 sheets or more were processed.

The amount of gelatin dissolved in the development processing solution was determined by molecular It is apparent from the results as shown in Table 2 that the occurrence of reticulation is remarkably improved, further the covering power is high and the scum inhibition property is remarkably improved by the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon a light-sensitive silver halide emulsion layer and a light-insensitive uppermost layer, wherein the light-insensitive uppermost layer has a melting time longer than that of the light-sensitive silver halide emulsion layer and a thickness of the light-insensitive uppermost layer is from 0.3 μm to 0.8 μm, wherein the light-insensitive uppermost layer is hardened with a diffusion-resistant polymeric hardening agent.

2. The silver halide photographic light-sensitive material as claimed in claim 1, wherein the relation between the melting time of the light-insensitive uppermost layer (MTi) and that of the light-sensitive silver halide emulsion layer (MTs) represented by MTi/MTs ratio is in a range of more than 1.05 and less than 20.

3. The silver halide photographic light-sensitive material as claimed in claim 1, wherein the relation between the melting time of the light-insensitive uppermost layer (MTi) and that of the light-sensitive silver halide emulsion layer (MTs) represented by MTi/MTs ratio is in a range of more than 1.05 and less than 10.

4. The silver halide photographic light-sensitive material as claimed in claim 1, wherein the relation between the melting time of the light-insensitive uppermost layer (MTi) and that of the light-sensitive silver halide emulsion layer (MTs) represented by MTi/MTs ratio is in a range of more than 3 and less than 6.

5. The silver halide photographic light-sensitive material as claimed in claim 1, wherein the polymeric hardening agent is a polymer having a repeating unit having a vinyl-sulfone group.

6. The silver halide photographic light-sensitive material as claimed in claim 1, wherein the diffusion-resistant polymeric hardening agent has a molecular weight of more than about 10,000 and at least one functional group reactive to gelatin to form crosslinking.

7. The silver halide photographic light-sensitive material as claimed in claim 1, wherein the diffusion-resistant polymeric hardening agent has a repeating unit of the formula (I):

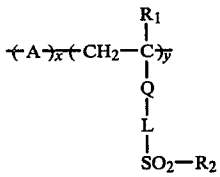

(I)

wherein A is a monomer unit prepared by copolymerizing copolymerizable ethylenically unsaturated monomers; $R_1$ is hydrogen or a lower alkyl group having 1 to 6 carbon atoms; Q is

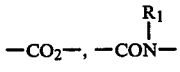

(wherein $R_1$ is the same as defined above) or an arylene group having 6 to 10 carbon atoms; L is a divalent group having 3 to 15 carbon atoms and containing at least one linking group selected from the members consisting of

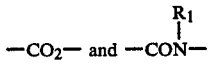

(wherein $R_1$ is the same as defined above) or a divalent group having 1 to 12 carbon atoms and containing at least one linking group selected from the members consisting of

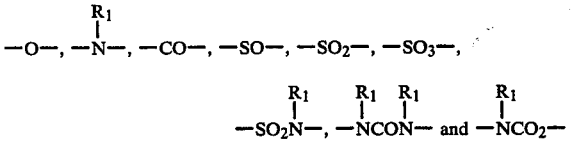

(wherein $R_1$ is the same as defined above); $R_2$ is $-CH{=}CH_2$ or $-CH_2CH_2X$ (wherein X is a group capable of being substituted with a nucleophilic group or a group capable of being released in the form of HX upon a base); and x and y each represents molar percent, x being between 0 and 99 and y being between 1 and 100.

8. The silver halide photographic light-sensitive material as claimed in claim 1, wherein the diffusion-resistant polymeric hardening agent has a repeating unit of the formula (II):

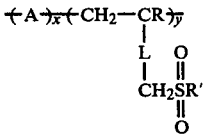

(II)

wherein A is a polymerized $\alpha,\beta$-ethylenically unsaturated addition polymerizable monomer or a mixture of such polymerizable monomers, x is a molar unit of from 10 to 95, and y is a molar unit of from 5 to 90, L is a linking group selected from the group consisting of alkylene, arylene, COZ and $COZR_3$, $R_3$ is selected from the group consisting of alkylene and arylene, Z is O or NH, R is hydrogen or alkyl having 1 to 6 carbon atoms, and R' is $-CH{=}CHR_2$ or $-CH_2CH_2X$ where X is a leaving group which can be displaced by a nucleophile or can be eliminated in the form of HX upon treatment with base and $R_2$ is hydrogen, alkyl or aryl.

9. The silver halide photographic light-sensitive material as claimed in claim 1, wherein the diffusion-resistant polymeric hardening agent contains (i) 5 to 100 molar percent of a repeating unit of the general formula (III):

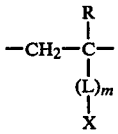

(III)

wherein R is hydrogen or an alkyl group having 1 to 6 carbon atoms; L, if present, is a divalent linking group having 1 to 20 carbon atoms; X is an active carboxylic ester group; and m is 0 or 1; and optionally contains (ii) 0 to 95 molar percent of one or more other monomer unit "A".

10. The silver halide photographic light-sensitive material as claimed in claim 1, wherein the diffusion-resistant polymeric hardening agent has a repeating unit selected from the group consisting of:

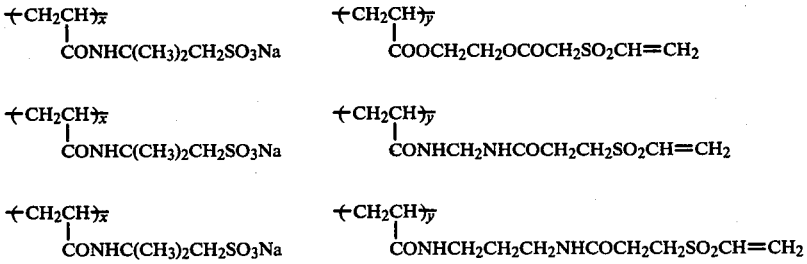

-continued $\leftarrow CH_2CH\rightarrow_x$ | $CONHC(CH_3)_2CH_2SO_3Na$ $\leftarrow CH_2CH\rightarrow_y$ 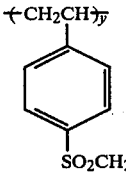

$SO_2CH_2CH_2SO_2CH{=}CH_2$ $\leftarrow CH_2CH\rightarrow_x$ | $CONHC(CH_3)_2CH_2SO_3Na$ $\leftarrow CH_2CH\rightarrow_y$ 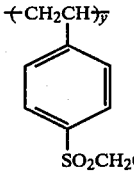

$SO_2CH_2CH_2SO_2CH_2CH(OH)CH_2SO_2CH{=}CH_2$ $\leftarrow CH_2CH\rightarrow_x$ | $CONHC(CH_3)_2CH_2SO_3Na$ $\leftarrow CH_2CH\rightarrow_y$ 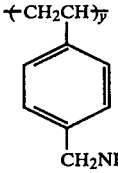

$CH_2NHCOCH_2CH_2SO_2CH{=}CH_2$ $\leftarrow CH_2CH\rightarrow_x$ | $CONHC(CH_3)_2CH_2SO_3Na$ $\leftarrow CH_2CH\rightarrow_y$ | $NHCONHCH_2SO_2CH{=}CH_2$ $\leftarrow CH_2CH\rightarrow_x$ | $CONHC(CH_3)_2CH_2SO_3Na$ $\leftarrow CH_2CH\rightarrow_y$ | $CONHCOCH_2CH_2SO_2CH{=}CH_2$ $\leftarrow CH_2CH\rightarrow_x$ | $CONHC(CH_3)_2CH_2SO_3Na$ $\leftarrow CH_2CH\rightarrow_y$ | $COOCH_2CH_2OCOCH_2SO_2CH_2CH_2Cl$ $\leftarrow CH_2CH\rightarrow_x$ | $CONHC(CH_3)_2CH_2SO_3Na$ $\leftarrow CH_2CH\rightarrow_y$ | $CONHCH_2NHCOCH_2CH_2SO_2CH_2CH_2Cl$ $\leftarrow CH_2CH\rightarrow_x$ | $CONHC(CH_3)_2CH_2SO_3Na$ $\leftarrow CH_2CH\rightarrow_y$ | $CONHCH_2NHCOCH_2CH_2SO_2CH_2CH_2Br$ $\leftarrow CH_2CH\rightarrow_x$ | $CONHC(CH_3)_2CH_2SO_3Na$ $\leftarrow CH_2CH\rightarrow_y$ 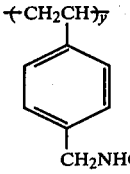

$CH_2NHCOCH_2CH_2SO_2CH_2CH_2Cl$ $\leftarrow CH_2CH\rightarrow_x$ | $CONHC(CH_3)_2CH_2SO_3Na$ $\leftarrow CH_2CH\rightarrow_y$ 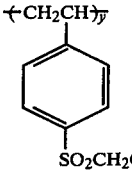

$SO_2CH_2CH_2SO_2CH_2CH(OH)CH_2SO_2CH_2CH_2Cl$ $\leftarrow CH_2CH\rightarrow_x$ | $CONHC(CH_3)_2CH_2SO_3Na$ $\leftarrow CH_2CH\rightarrow_y$ | $CONHCOCH_2CH_2SO_2CH_2CH_2Cl$ $\leftarrow CH_2CH\rightarrow_x$ | $COOM$ $\leftarrow CH_2CH\rightarrow_y$ | $CONHCH_2COCH_2CH_2SO_2CH_2CH_2Cl$ $\leftarrow CH_2CH\rightarrow_x$ | $COOM$ $\leftarrow CH_2CH\rightarrow_y$ | $CONHCH_2NHCOCH_2CH_2SO_2CH{=}CH_2$ -continued
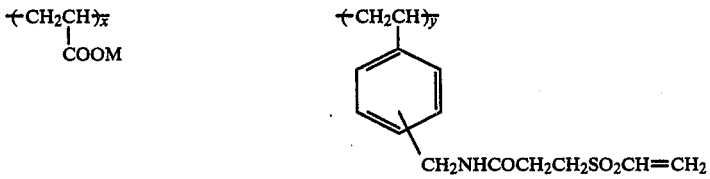
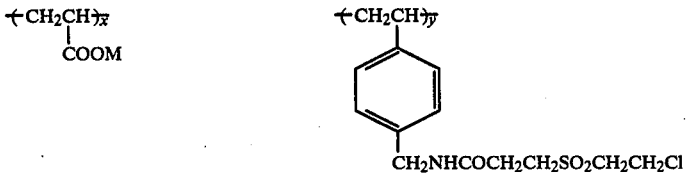
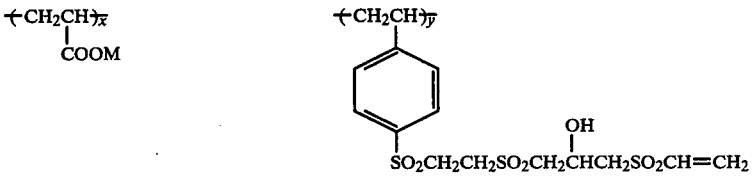
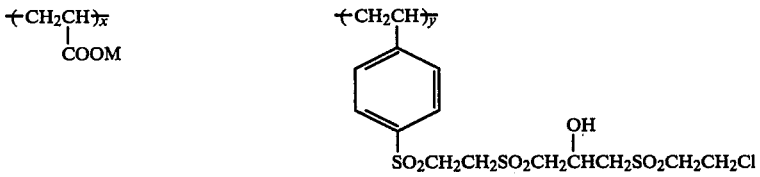
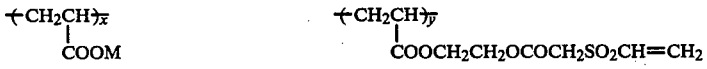
and
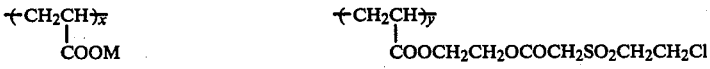
wherein M is hydrogen, a sodium atom or a potassium atom, and x and y represent molar percent, x being from 0 to 99, and y being from 1 to 100.
11. The silver halide photographic light-sensitive material as claimed in claim 1, wherein the diffusion resistant polymeric hardening agent has a repeating unit selected from the group consisting of:
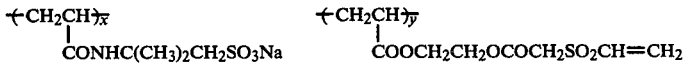
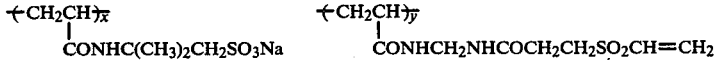
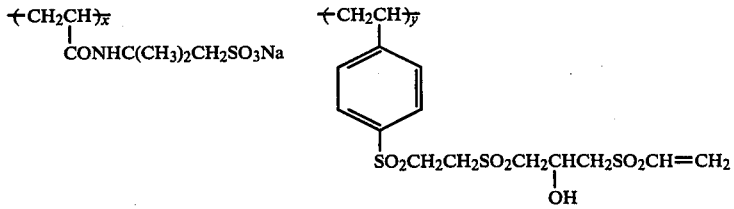
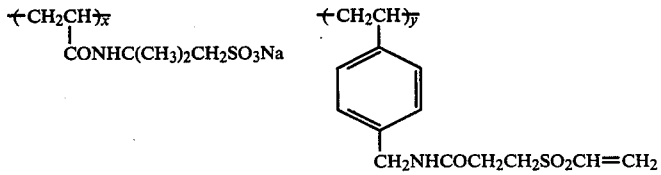

-continued and

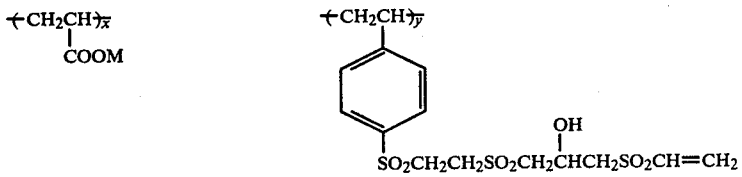

wherein x and y represent molar percent, x being from 0 to 99, and y being from 1 to 100.

12. The silver halide photographic light-sensitive material as claimed in claim 1, wherein the diffusion-resistant polymeric hardening agent has a repeating unit selected from the group consisting of:

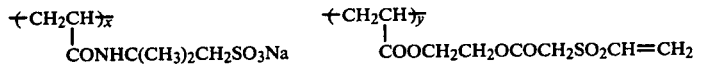

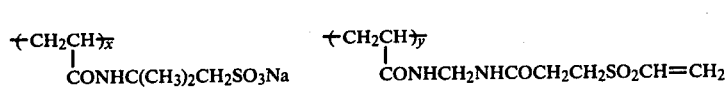

and

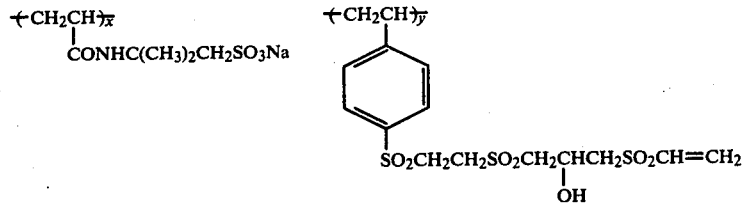

wherein x and y represent molar percent, x being from 0 to 99 and y being from 1 to 100.

13. The silver halide photographic light-sensitive material as claimed in claim 1, wherein the light-insensitive uppermost layer further contains a low molecular diffusible hardening agent.

14. The silver halide photographic light-sensitive material as claimed in claim 13, wherein the low molecular diffusible hardening agent is an active vinyl hardening agent.

15. The silver halide photographic light-sensitive material as claimed in claim 1, wherein the melting time of the light-insensitive uppermost layer is from 200 seconds to 700 seconds and the melting time of the light-sensitive silver halide emulsion layer is from 30 to 200 seconds when the melting time is measured in a 0.2N NaOH solution maintained at 60° C.

16. The silver halide photographic light-sensitive material as claimed in claim 1, wherein a thickness of the light-sensitive silver halide emulsion layer is from 1 μm to 15 μm.

17. The silver halide photographic light-sensitive material as claimed in claim 1, wherein a gelatin-containing light-insensitive layer is provided under the light-sensitive silver halide emulsion layer.

18. The silver halide photographic light-sensitive material as claimed in claim 1, wherein a light-sensitive silver halide emulsion layer is provided on both sides of the support and the light-insensitive uppermost layer is provided on the outside of the silver halide emulsion layer existing on both sides of the support.

19. A method of forming a photographic image without the formation of reticulation and scum which comprises developing an imagewise exposed silver halide photographic light-sensitive material comprising a support having thereon a light-sensitive silver halide emulsion layer and a light-insensitive uppermost layer, wherein the light-insensitive uppermost layer has a melting time longer than that of the light-sensitive silver halide emulsion layer and the thickness of the light-insensitive uppermost layer is from 0.3 μm to 0.8 μm at a temperature of 27° C. or more, wherein the light-insensitive uppermost layer is hardened with a diffusion-resistant polymeric hardening agent.

20. The method of forming a photographic image as claimed in claim 19, wherein the development is carried out using an automatic developing apparatus.

21. The method of forming a photographic image as claimed in claim 19, wherein the relation between the melting time of the light-insensitive uppermost layer (MTi) and that of the light-sensitive silver halide emulsion layer (MTs) represented by MTi/MTs ratio is in a range of more than 1.05 and less than 20.

22. The method of forming a photographic image as claimed in claim 19, wherein the relation between the melting time of the light-insensitive uppermost layer (MTi) and that of the light-sensitive silver halide emulsion layer (MTs) represented by MTi/MTs is in a range of more than 1.05 and less than 10.

23. The method of forming a photographic image as claimed in claim 19, wherein the relation between the melting time of the light-insensitive uppermost layer (MTi) and that of the light-sensitive silver halide emulsion layer (MTs) represented by MTi/MTs ratio is in a range of more than 3 and less than 6.

24. The method of forming a photographic image as claimed in claim 19, wherein the polymeric hardening agent is a polymer having a repeating unit having a vinyl-sulfone group.

25. The method of forming a photographic image as claimed in claim 19, wherein the diffusion-resistant polymeric hardening agent has a molecular weight of more than about 10,000 and at least one functional group reactive to gelatin to form cross-linking.

26. The method of forming a photographic image as claimed in claim 19, wherein the diffusion-resistant polymeric hardening agent has a repeated unit of the formula (I):

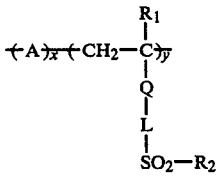

wherein A is a monomer unit prepared by copolymerizing copolymerizable ethylenically unsaturated monomers; $R_1$ is hydrogen or a lower alkyl group having 1 to 6 carbon atoms; Q is

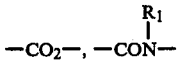

(wherein $R_1$ is the same as defined above) or an arylene group having 6 to 10 carbon atoms; L is a divalent group having 3 to 15 carbon atoms and containing at least one linking group selected from the members consisting of

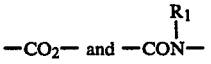

(wherein $R_1$ is the same as defined above) or a divalent group having 1 to 12 carbon atoms and containing at least one linking group selected from the members consisting of

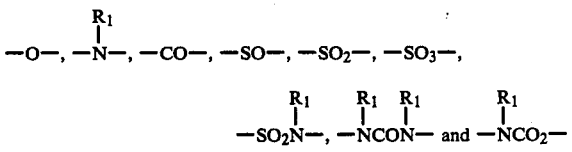

(wherein $R_1$ is the same as defined above); $R_2$ is $-CH{=}CH_2$ or $-CH_2CH_2X$ (wherein X is a group capable of being substituted with a nucleophilic group or a group capable of being released in the form of HX upon a base); and x and y each represents molar percent, x being between 0 and 99 and y being between 1 and 100.

27. The method of forming a photographic image as claimed in claim 19, wherein the diffusion-resistant polymeric hardening agent has a repeating unit of the formula (II):

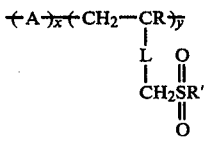

(II)

wherein A is a polymerized $\alpha,\beta$-ethylenically unsaturated addition polymerizable monomer or a mixture of such polymerizable monomers, x is a molar unit of from 10 to 95, and y is a molar unit of from 5 to 90, L is a linking group selected from the group consisting of alkylene, arylene, COZ and $COZR_3$, $R_3$ is selected from the group consisting of alkylene and arylene, Z is O or NH, R is hydrogen or alkyl having 1 to 6 carbon atoms, and R' is $-CH{=}CHR_2$ or $-CH_2CH_2X$ where X is a leaving group which can be displaced by a nucleophile or can be eliminated in the form of HX upon treatment with base and $R_2$ is hydrogen, alkyl or aryl.

28. The method of forming a photographic image as claimed in claim 19, wherein the diffusion-resistant polymeric hardening agent contains (i) 5 to 100 molar percent of a repeating unit of the general formula (III):

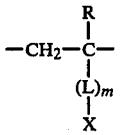

(III)

wherein R is hydrogen or an alkyl group having 1 to 6 carbon atoms; L, if present, is a divalent linking group having 1 to 20 carbon atoms; X is an active carboxylic ester group; and m is 0 or 1; and optionally contains (ii) 0 to 95 molar percent of one or more other monomer unit "A".

29. The method of forming a photographic image as claimed in claim 19, wherein the diffusion-resistant polymeric hardening agent has a repeating unit selected from the group consisting of:

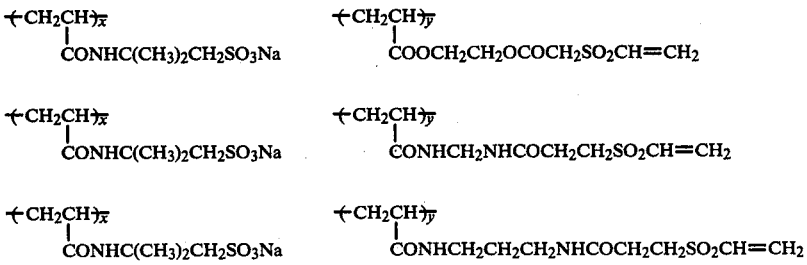

-continued $\leftarrow CH_2CH \rightarrow_x$ (CONHC(CH3)2CH2SO3Na) $\leftarrow CH_2CH \rightarrow_y$ (C6H4-SO2CH2CH2SO2CH=CH2)

$\leftarrow CH_2CH \rightarrow_x$ (CONHC(CH3)2CH2SO3Na) $\leftarrow CH_2CH \rightarrow_y$ (C6H4-SO2CH2CH2SO2CH2CH(OH)CH2SO2CH=CH2)

$\leftarrow CH_2CH \rightarrow_x$ (CONHC(CH3)2CH2SO3Na) $\leftarrow CH_2CH \rightarrow_y$ (C6H4-CH2NHCOCH2CH2SO2CH=CH2)

$\leftarrow CH_2CH \rightarrow_x$ (CONHC(CH3)2CH2SO3Na) $\leftarrow CH_2CH \rightarrow_y$ (NHCONHCH2SO2CH=CH2)

$\leftarrow CH_2CH \rightarrow_x$ (CONHC(CH3)2CH2SO3Na) $\leftarrow CH_2CH \rightarrow_y$ (CONHCOCH2CH2SO2CH=CH2)

$\leftarrow CH_2CH \rightarrow_x$ (CONHC(CH3)2CH2SO3Na) $\leftarrow CH_2CH \rightarrow_y$ (COOCH2CH2OCOCH2SO2CH2CH2Cl)

$\leftarrow CH_2CH \rightarrow_x$ (CONHC(CH3)2CH2SO3Na) $\leftarrow CH_2CH \rightarrow_y$ (CONHCH2NHCOCH2CH2SO2CH2CH2Cl)

$\leftarrow CH_2CH \rightarrow_x$ (CONHC(CH3)2CH2SO3Na) $\leftarrow CH_2CH \rightarrow_y$ (CONHCH2NHCOCH2CH2SO2CH2CH2Br)

$\leftarrow CH_2CH \rightarrow_x$ (CONHC(CH3)2CH2SO3Na) $\leftarrow CH_2CH \rightarrow_y$ (C6H4-CH2NHCOCH2CH2SO2CH2CH2Cl)

$\leftarrow CH_2CH \rightarrow_x$ (CONHC(CH3)2CH2SO3Na) $\leftarrow CH_2CH \rightarrow_y$ (C6H4-SO2CH2CH2SO2CH2CH(OH)CH2SO2CH2CH2Cl)

$\leftarrow CH_2CH \rightarrow_x$ (CONHC(CH3)2CH2SO3Na) $\leftarrow CH_2CH \rightarrow_y$ (CONHCOCH2CH2SO2CH2CH2Cl)

$\leftarrow CH_2CH \rightarrow_x$ (COOM) $\leftarrow CH_2CH \rightarrow_y$ (CONHCH2COCH2CH2SO2CH2CH2Cl)

$\leftarrow CH_2CH \rightarrow_x$ (COOM) $\leftarrow CH_2CH \rightarrow_y$ (CONHCH2NHCOCH2CH2SO2CH=CH2)

-continued
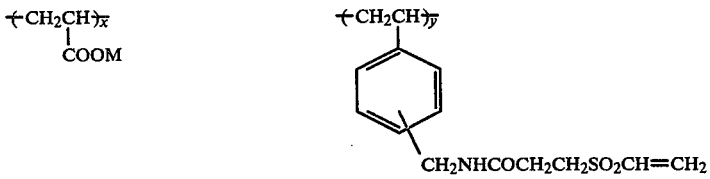
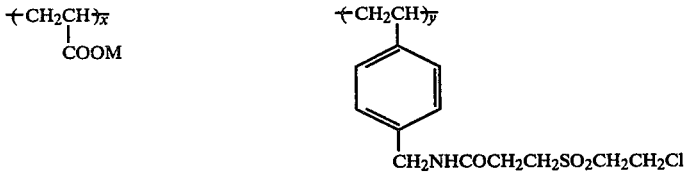
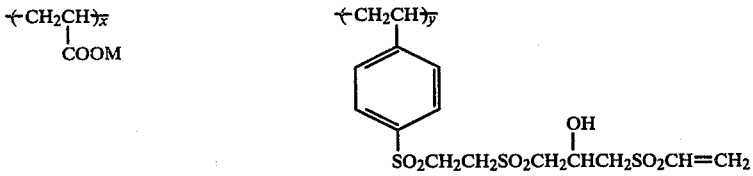
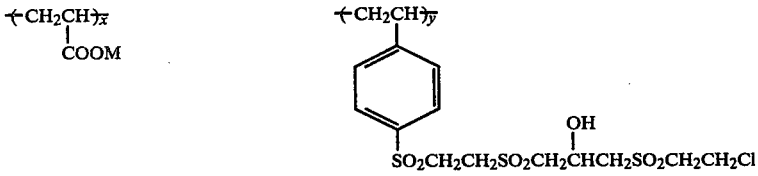
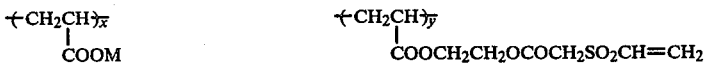
and
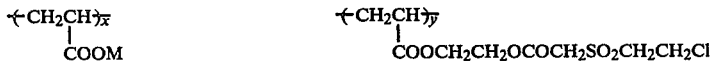
wherein M is hydrogen, a sodium atom or a potassium atom, and x and y represent molar percent, x being from 0 to 99, and y being from 1 to 100.
30. The method of forming a photographic image as claimed in claim 19, wherein the diffusion resistant polymeric hardening agent has a repeating unit selected from the group consisting of:
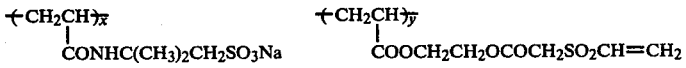
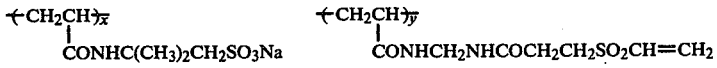
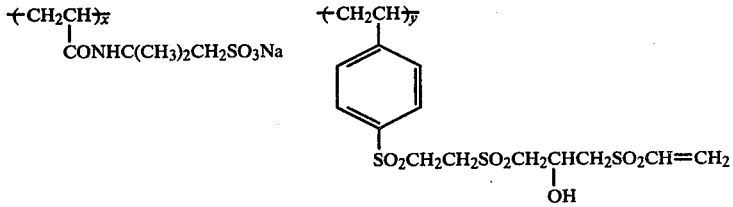
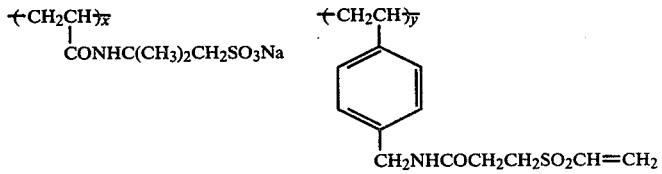

-continued and

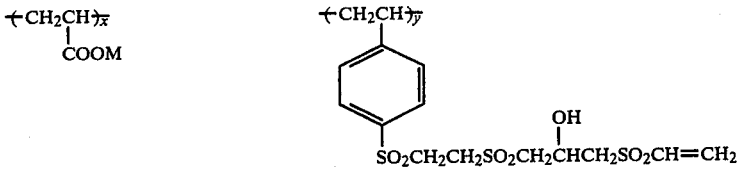

wherein x and y represent molar percent, x being from 0 to 99, and y being from 1 to 100.

31. The method of forming a photographic image as claimed in claim 30, wherein the diffusion-resistant polymeric hardening agent has a repeating unit selected from the group consisting of:

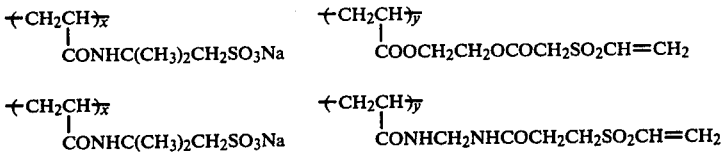

and

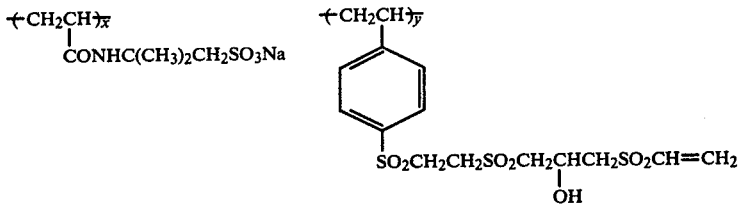

wherein x and y represent molar percent, x being from 0 to 99 and y being from 1 to 100.

32. The method of forming a photographic image as claimed in claim 19, wherein the light-insensitive uppermost layer further contains a low molecular diffusible hardening agent.

33. The method of forming a photographic image as claimed in claim 32, wherein the low molecular diffusible hardening agent is an active vinyl hardening agent.

34. The method of forming a photographic image as claimed in claim 19, wherein the melting time of the light-insensitive uppermost layer is from 200 seconds to 700 seconds and the melting time of the light-sensitive silver halide emulsion layer is from 30 to 200 seconds when the melting time is measured in a 0.2N NaOH solution maintained at 60° C.

35. The method of forming a photographic image as claimed in claim 19, wherein a thickness of the light-sensitive silver halide emulsion layer is from 1 μm to 15 μm.

36. The method of forming a photographic image as claimed in claim 19, wherein a gelatin-containing light-insensitive layer is provided under the light-sensitive silver halide emulsion layer.

37. The method of forming a photographic image as claimed in claim 19, wherein a light-sensitive silver halide emulsion layer is provided on both sides of the support and the light-insensitive uppermost layer is provided on the outside of the silver halide emulsion layer existing on both sides of the support.

* * * * *